United States Patent [19]

Welles

[11] 4,379,538

[45] Apr. 12, 1983

[54] ARTICLE SUPPORTING DEVICE

[76] Inventor: Theodore W. Welles, 23400 Shaker Blvd., Shaker Heights, Ohio 44122

[21] Appl. No.: 212,494

[22] Filed: Dec. 3, 1980

[51] Int. Cl.[3] ..... B65B 67/12

[52] U.S. Cl. ..... 248/95; 248/311.2

[58] Field of Search ..... 248/95, 99, 100, 311.2; 53/390; 150/51; 24/16 PB

[56] References Cited

U.S. PATENT DOCUMENTS

| | | | |
|---|---|---|---|
| 1,447,012 | 2/1923 | Daniel . | |
| 1,553,199 | 9/1925 | Stewart . | |
| 1,945,932 | 2/1934 | Caley | 24/201.1 UX |
| 2,353,316 | 7/1944 | Muller | 24/201 A X |
| 3,148,812 | 9/1964 | Hilsinger | 224/5 |
| 3,300,164 | 1/1967 | Welles | 248/95 |
| 3,339,247 | 9/1967 | Geisinger | 24/16 PB |
| 3,416,198 | 12/1968 | Geisinger | 24/16 PB |
| 3,516,631 | 6/1970 | Santucci | 248/71 |
| 3,537,109 | 11/1970 | Spurrier et al. | 9/110 |
| 3,542,321 | 11/1970 | Kahabka | 248/68 |
| 3,677,250 | 7/1972 | Thomas | 128/348 |
| 3,779,496 | 12/1973 | Welles | 248/99 |
| 4,101,104 | 7/1978 | Minard | 248/95 |

FOREIGN PATENT DOCUMENTS

| | | | |
|---|---|---|---|
| 861929 | 3/1961 | United Kingdom | 248/74 PB |
| 1052285 | 12/1966 | United Kingdom | 248/74 PB |

*Primary Examiner*—J. Franklin Foss

*Attorney, Agent, or Firm*—Body, Vickers & Daniels

[57] ABSTRACT

An article supporting device adhesively mountable on a surface such as the dashboard of a vehicle is formed from thin flexible plastic material to have integral mounting and strap portions, the strap portion being displaceable into a loop configuration for supporting an article such as a litter bag. The mounting portion is provided with an integral button, and the strap portion has an outer end provided with a slit to receive the button for the latter to retain the strap in the loop configuration. The strap portion is provided with a constraining member of plastic material integral therewith and positioned therealong to constrain the loop to have a generally uniform curvature under the weight of an article supported thereby. A litter bag stay device can be removably associated with the loop to engage against the back wall and between the side walls of a litter bag supported by the loop. The stay restrains collapse of the bag under the weight of articles therein, and stabilizes the bag against displacement relative to the article holder during manipulation of the bag to introduce articles thereinto.

16 Claims, 7 Drawing Figures

ARTICLE SUPPORTING DEVICE

BACKGROUND OF THE INVENTION

This invention relates to the art of supports and, more particularly, to a support mountable on a surface for supporting an article in suspension relative thereto.

The present invention is particularly adapted for supporting paper or plastic litter bags from the dashboard of a vehicle and accordingly will be described with particular reference thereto. However, it will be appreciated that the supporting device of the invention can be mountable on a surface other than a dashboard and is adapted for supporting articles other than litter bags and, for example, may be mounted on a kitchen wall or cabinet surface for supporting household articles.

Article supports have been provided heretofore which include a mounting portion adapted to be adhesively or otherwise attached to a support surface, and an article supporting portion in the form of a hook or ring attached to the mounting portion to receive an article to be supported. An example of such a previous article holding device is disclosed in my U.S. Pat. No. 3,300,164, wherein the article holding portion of the device is a split ring of relatively thick plastic material attached to an adhesively backed sheet of plastic material which is sufficiently thin to be quite flexible so as to readily conform with the contour of a surface on which the support device is to be mounted. The split ring has a preformed contour and, while flexible, has sufficient rigidity to retain its contour under the weight of an article supported thereby. Another example of such a split ring article holder is disclosed in my U.S. Pat. No. 3,779,496 together with a bag shaping component mountable on the ring and received in the open upper end of a litter bag supported on the ring. The split ring in the latter patent is also of relatively thick and rigid plastic material and is separately attached to an adhesively backed mounting sheet of plastic material. The bag shaping component is generally U-shaped and engages inside a litter bag along the back wall and outwardly along the opposite sidewalls thereof to maintain the bag open, and is provided with a circular opening receiving the split ring so as to be supported thereby.

While such article holders serve their intended function, the cost of manufacture thereof is undesirably high, the rigid configuration and size of the article holding portion creates problems with regard to storage and shipping of the device, and certain structural aspects thereof limit its useful life. With regard first to the cost of manufacture, the split ring portion must be formed and then attached to the mounting portion, whereby a number of steps are required in the manufacturing procedure. The cost of manufacture is of course related to the time required to produce and assemble the component parts and is increased in proportion to the number of steps required. Additionally, cost of production is related to the amount of plastic material required for the support device, and it will be appreciated that the relatively thick walled plastic ring requires a considerable amount of plastic material to achieve the necessary rigidity therefor. With regard to shipping and storage problems, it will be appreciated that the ring portion of the supporting device rigidly occupies space outwardly of the mounting portion, whereby more space is required to ship or store a given number of the devices than would be necessary if the devices were of a flatter configuration. Such space requirements of course affect shipping costs and, together with cost of manufacture, affect the cost of the supporting device to the consumer. From the standpoint of structural integrity, the attachment of the ring portion to the mounting portion, such as by a fastener element or adhesive, creates an area of weakness in the article support and/or a stress relationship between the ring component and mounting portion which promotes separation of the mounting portion from the surface on which it is mounted and/or separation of the ring from the mounting portion under the weight of an article supported by the ring. In this respect, the ring extends forwardly from the plane of the mounting portion whereby the weight of an article suspended from the ring stresses the material of the mounting portion in the area of connection with the ring. As a result of such stress, the material of the mounting portion is pulled outwardly and downwardly relative to the support surface therebehind, promoting separation of the mounting portion from the support surface and/or tearing of the mounting portion in the area of connection with the ring and thus separation of the ring therefrom.

The bag shaping component referred to hereinabove also serves its intended function in holding the upper end of a litter bag in an open condition, but the three dimensional U-shaped configuration thereof and the amount of plastic material required results in an undesirably high cost of manufacture. Further, the U-shaped configuration and the rigidity of the plastic material creates space problems with regard to shipping and storage which affect cost to the customer as mentioned hereinabove with regard to the rigid ring type article holders. Still further, the circular opening by which the bag shaping component is supported on the ring allows the article shaping device and thus the litter bag to freely swing relative to the ring, whereby the user of the litter bag must often stabilize the bag with one hand while introducing an article thereinto with the other hand.

SUMMARY OF THE INVENTION

In accordance with one aspect of the present invention, an improved article support is provided which overcomes the foregoing problems with regard to rigid split ring type supports. More particularly in this respect, an article support according to the present invention comprises integral mounting and strap portions of extremely thin flexible plastic material, the mounting portion being adapted to be secured to a support surface, such as by an adhesive, and the strap portion being adapted to be displaced from a coplanar relationship with the mounting portion to form a loop for supporting an article. The strap portion is adapted to be releaseably secured in the loop configuration, thus to facilitate the introduction and removal of an article therefrom.

The mounting and strap portions are preferably of one piece construction and are produced from plastic material such as polyethylene having a thinness which provides for the plastic material to be extremely flexible, thus enabling the mounting portion to readily conform to the contour of a surface on which the support is mounted. Further, the structural relationship between the strap portion and mounting portion advantageously provides for distribution of the weight of an article supported such that part of the weight is imposed on the mounting portion through the strap portion substantially in the plane of the mounting portion, thus minimizing the application of stress to the mounting portion in a direction outwardly of the plane thereof. Importantly in connection with the present invention, the strap portion is constrained to form a loop having a generally uniform curvature under the weight of an article supported thereby. Accordingly, such constraining provides the strap portion with the needed structural integrity for supporting an article while minimizing the amount of plastic material required to produce the article support.

In accordance with a preferred embodiment of the invention, the strap portion is releasably retained in the loop configuration by means of a button formed integrally with the mounting portion, and a button receiving slit in the strap portion. Further, the desired constraining of the strap portion is achieved by a plastic constraining member formed integrally with the strap portion. The preferred construction advantageously enables the article support to be of one piece construction readily produced such as by molding, thus minimizing manufacturing time and expense. In any event, an article support according to the present invention is economical with regard to the amount of material used to produce the same, has a relatively flat configuration prior to use, thus optimizing the use of space with respect to shipment and storage thereof, and has a structure which enables achieving the foregoing advantages without sacrificing structural integrity in connection with supporting an article during use thereof.

In accordance with another aspect of the present invention, an improved bag stay component is provided for ring or loop-type article supports and which stay is economical to produce and provides improved stability with respect to a bag with which the stay is associated in a mounting arrangement on the article support. More particularly, the stay component is a generally planar member produced from thin plastic material such as polypropylene received in the open upper end of a bag to be supported by the ring or loop-type article support. The stay component engages the back wall of the bag and extends between the sidewalls of the bag, thus to maintain the back wall of the bag in a planar condition upon opening the bag such as by pulling outwardly on the front wall thereof. The stay has an opening therethrough receiving the loop or ring of the article support and interengaging therewith in a manner which restrains tipping or pivoting of the stay and thus the bag about the axis of the opening. Further, the stay includes a projection perpendicular to the plane thereof and engaging the ring or loop in the bite area thereof so as to restrain tilting of the stap component and thus the bag in the direction forwardly and rearwardly with respect to the ring or loop. Accordingly, the opening and projection interengage with the ring or loop to stabilize the stay and thus the bag associated therewith to facilitate the introduction of an article into the bag.

It is accordingly an outstanding object of the present invention to provide an improved article support of the character adapted to be mounted on a surface so as to support an article in suspension therefrom.

Another object is the provision of an article support of the foregoing character which includes mounting and strap portions structured and interrelated in a manner to enable the use of extremely thin and flexible plastic material therefor.

A further object is the provision of an article support of the foregoing character comprising mounting and strap portions and in which the strap portion is adapted to form a loop for supporting an article and is constrained to provide for the loop to have a generally uniform curvature under the weight of an article supported thereby.

Still a further object is the provision of an article support of the foregoing character in which the strap portion is structurally interrelated with the mounting portion in a manner which minimizes the application of stress to the mounting portion outwardly of the plane thereof by the weight of an article being supported.

Still a further object is the provision of an article support of the foregoing character which is of one-piece construction.

Yet another object is the provision of an article support of the foregoing character which is economical to produce, minimizes space requirements with respect to storage and packaging for shipment, and which is efficient in use.

A further object is the provision of an improved bag stay component for use with a ring or loop-type article support device and which is cooperable therewith and with a bag supported thereby to stabilize a wall of the bag against collapse during use thereof and to stabilize the bag against swinging movement relative to the article support.

Yet a further object is the provision of a bag stay of the foregoing character which is economical to produce and minimizes space requirements with respect to storage and packaging for shipment.

BRIEF DESCRIPTION OF THE DRAWINGS

The foregoing objects, and others, will in part be obvious and in part pointed out more fully hereinafter in conjunction with the written description of a preferred embodiment illustrated in the accompanying drawings in which.

DESCRIPTION OF A PREFERRED EMBODIMENT

Figure 1:
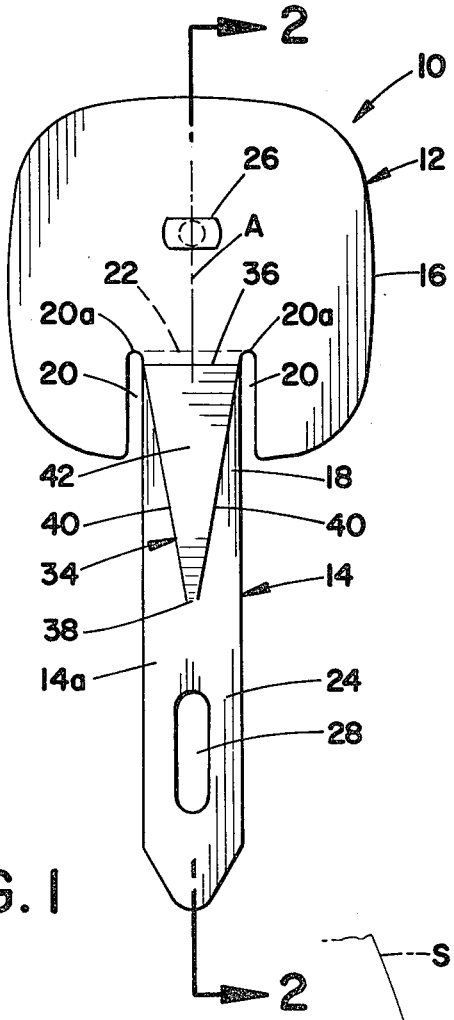
FIG. 1 is a front elevation view of an article support made in accordance with the present invention.
Figure 2:
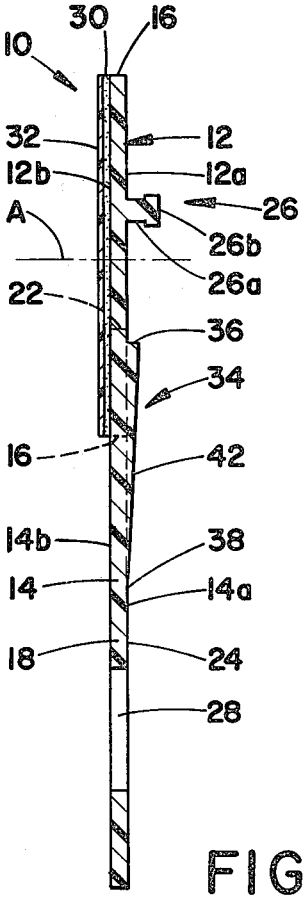
FIG. 2 is a sectional elevation view of the article support taken along line 2—2 in FIG. 1.

Referring now in greater detail to the drawings, wherein the showings are for the purpose of illustrating preferred embodiments of the invention only and not for the purpose of limiting the invention, FIGS. 1 and 2 illustrate an article support 10 comprising a mounting portion 12 and an integral strap portion 14 of thin flexible plastic material, such as polyethylene. Mounting portion 12 has front and back sides **12*a* and 12*b*, respectively, and strap portion 14 has corresponding front and back sides 14*a* and 14*b*. Mounting portion 12 has an outer peripheral edge 16 with respect to a central axis A perpendicular to the plane of the mounting portion and which peripheral edge may provide the mounting portion with any desired peripheral contour. In the embodiment illustrated, strap portion 14 has an inner end 18 defined by a pair of parallel slits 20 extending radially inwardly of peripheral edge 16 and having terminal ends 20***a* spaced inwardly of the peripheral edge and defining a line of juncture 22 between mounting portion 12 and inner end 18 of strap portion 14. Strap portion 14 extends radially outwardly of peripheral edge 16 and has an outer end 24 spaced outwardly from the peripheral edge and from line of juncture 22.

As set forth more fully hereinafter, outer end 24 of strap portion 14 is adapted to be displaced back toward mounting portion 12 to provide an article supporting loop and, in connection therewith, outer end 24 is adapted to be releaseably fastened in the loop configuration. In the embodiment illustrated, such fastening is achieved by providing the front side of mounting portion 12 with a button member 26 having a shank 26*a* and an enlarged head 26*b*, and by providing outer end 24 of strap portion 14 with a button receiving slit 28. Preferably, button member 26 is integrally formed with mounting portion 12, but it will be appreciated that the button member could be otherwise secured to mounting portion 12 such as by a suitable adhesive, heat welding or the like. Furthermore, it will be appreciated that other releaseable fastener arrangements may be employed such as, for example, Velcro fasteners, interengaging snap components, or the like. An integral button member and a slit in the strap portion is preferred in that it advantageously enables a one-piece construction and a one-step manufacturing procedure by avoiding the use of a separate fastener component and the attachment thereof to the mounting portion.

Article support 10 is adapted to be mounted on a support surface, such as the dashboard of a motor vehicle, and for this purpose back side 12*b* of mounting portion 12 is provided with a thin layer of pressure sensitive adhesive 30 protected by a sheet of backing material 32 which, in a well known manner, is adapted to be stripped from the adhesive when mounting of the article support is desired. While such pressure sensitive adhesive is preferred, it will be appreciated that mounting of the article holder can be otherwise achieved. In this respect, for example, back side 12*b* of the mounting portion could be provided with magnetic material to facilitate mounting on a metal surface or, as another example, could be provided with a solvent activated adhesive.

As mentioned hereinabove, the plastic material of mounting portion 12 and strap portion 14 is extremely thin and flexible, and in the preferred embodiment, mounting portion 12 has a thickness transverse to the front and back sides thereof of 0.040 inch and strap portion 14 has a thickness of 0.060 inch. However, the mounting portion and strap portion can be of the same thickness, in which case the preferred thickness would be 0.060 inch. The thickness of 0.040 inch for mounting portion 12 is preferred in that it facilitates mounting the article support on a curved or irregular surface with increased integrity against separation therefrom. It will be appreciated that a thickness of 0.060 inch for the plastic material of the strap portion provides very little resistance to bending or folding of the material, whereby a loop formed by fastening the end of the strap portion to the button tends to sag in the bight portion rather than to gradually curve through the bight portion. Such sagging is promoted by the weight of an article supported in suspension thereon and is undesirable in that it tends to stress the strap portion along a line transverse thereto and between the ends of the loop. Under sufficient weight and/or over a period of time such sagging can cause a rather sharp fold line to form in the bight area which would promote breaking of the strap. The occurrance of such breaking would of course depend on such factors as the weight imposed thereon, vibration or movement of an article relative to the strap, as would occur with a litter bag in a vehicle during operation of the vehicle, and impacts of the article against the strap such as would result from the dropping of refuse into a litter bag.

In accordance with the present invention, such folding of the strap portion when the latter is in the article supporting loop configuration is avoided by constraining the strap portion so that the loop has a generally uniform curvature under the weight of an article supported thereby. In the preferred embodiment, such constraining is achieved by a constraining member 34 integral with the strap portion and extending therealong in the direction from line of juncture 22 toward outer end 24 of the strap portion. More particularly, constraining member 34 has an inner end 36 adjacent line of juncture 22, an outer end 38 intermediate the inner and outer ends of the strap portion, and opposite linear side edges 40 extending between ends 36 and 38. Side edges 40 converge with respect to one another in the direction from end 36 toward end 38, and the constraining member has a planar outer surface 42 which converges with respect to front side 14*a* of strap portion 14 in the direction from inner end 36 toward outer end 38 and merges with front side 14*a* at the latter end. The constraining member has a length along strap portion 14 between inner end 36 and outer end 38 sufficient to provide for the constraining member to extend through the bight portion of the loop formed by strap portion 14, as explained more fully hereinafter. It will be appreciated that the converging relationship between side edges 40 of the constraining member and the converging relationship between outer surface 42 thereof and front side 14*a* of the strap portion provides for the constraining member to have a progressively decreasing cross-sectional area in the direction from inner end 36 toward outer end 38 thereof.

Figure 3:
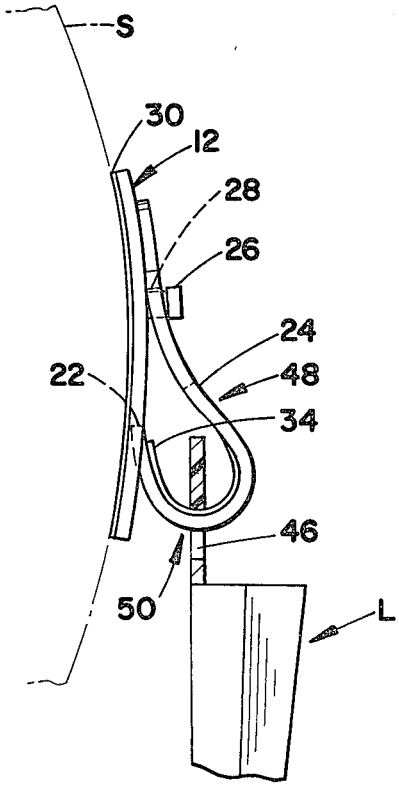
FIG. 3 is a side elevation view showing the article support mounted on a surface and supporting an article in suspension.

With reference now to FIG. 3 of the drawing, the article support is illustrated mounted on a support surface S, such as the dashboard of a motor vehicle, and supporting an article L such as a litter bag thereon. More particularly in this respect, once mounting portion 12 has been secured to surface S, outer end 24 of strap portion 14 is passed through an opening 46 in the litter bag and is then attached to button member 26 by introducing the latter through slit 28 in the strap portion, thus forming a loop 48 having a bight portion 50 engaged by litter bag L. Constraining member 34 constrains the bight portion of the loop to have a generally uniform curvature from the line of juncture 22 with mounting portion 12 and along the length of the constraining member. Without constraining member 34 the bight portion would sag and have a pronounced lowermost point in the area engaged by the litter bag, and such sagging would progressively increase with the increase of weight as refuse is introduced into the bag. It will be appreciated from FIG. 3 that a portion of the stress imposed on the loop by the weight of an article suspended therefrom is transmitted through strap portion 14 to mounting portion 12 across the line of juncture 22 therebetween, whereby only a portion of the stress is imposed on button member 26 and thus the area of juncture thereof with mounting portion 12.

As an example of the dimensional relationships of the component parts in the preferred embodiment enabling constraint of the strap portion as shown in FIG. 3 and described above, the plastic material of the mounting portion and strap portion have the respective thicknesses mentioned above, and strap portion 14 has a width of 0.50 inch and a length from line of juncture 22 to the lower end of slit 28 of about 2.40 inches. Line of juncture 22 is about 0.25 inch below axis A, and button 26 is spaced about 0.25 inch above axis A and projects outwardly of front side 12*a* of mounting portion 12 about 0.20 inch. Constraining member 34 has a length of 1.30 inch along strap portion 14 from line of juncture 22, has a width at inner end 36 corresponding to that of strap portion 14, and side edges 40 thereof taper almost to a point at outer end 38 of the constraining member. Still further, inner end 36 of the constraining member has a thickness perpendicular to front side 14*a* of strap portion 14 of about 0.015 inch and tapers to the plane of front side 14*a* at outer end 38 thereof. Peripheral edge 16 of the mounting portion has horizontal and vertical dimensions transverse to axis A of about 1.85 inch.

The diminishing cross-sectional area configuration of the constraining member in the preferred embodiment advantageously provides for decreasing the resistance to bending progressively outwardly of inner end 36 of the constraining member causing the bight portion to curve generally uniformly as opposed to sagging under the weight of an article thereon. At the same time, it will be appreciated that the desired curvature in the bight portion of the loop can be achieved by a configuration of the constraining member other than that illustrated and described herein. In this respect, for example, the constraining member could have a width throughout its length corresponding to that of the strap portion with the outer surface of the constraining member concave with respect to and converging toward the outer side of the strap portion so as to merge therewith in the area corresponding to the outer end of the bight portion. Furthermore, it will be appreciated that the configuration and location of the constraining member along the strap portion is also dependent on the strap length and the positional relationship between the inner and outer ends of the strap portion when the latter is in the loop configuration thereof. In this respect, for example, the strap portion could be of a length which would provide for the bight portion of the loop to be spaced considerably below the line of juncture between the strap portion and mounting portion, in which case the constraining member could be of uniform width and thickness along the length thereof. Likewise, with regard to a modification of the latter character, it will be appreciated that button member 26 could be positioned at the line of juncture between the strap portion and mounting portion as opposed to being spaced therefrom as in the preferred embodiment. Still further, it will be appreciated that the line of juncture between the strap portion and mounting portion could be along the outer peripheral edge of the mounting portion as opposed to being spaced inwardly therefrom. The latter construction is preferred in that it promotes minimizing the overall size of the article support while providing the mounting portion with adequate surface area for securely mounting the article support on a support surface and, additionally, restrains separation of the mounting portion from the support surface under the weight of an article thereon, especially when the mounting surface is curved.

While the constraining member is preferably formed integral with the strap portion so as to enable a one-piece construction and a one-step operation in producing the article support, it will be appreciated that the constraining member could be a plastic member formed separately from the strap portion and suitably secured thereto such as by adhesive bonding or heat welding. Moreover, it will be appreciated that the constraining member could be on back side 14*b* of the strap portion rather than the front side, or partially on each of the front and back sides of the strap portion. It is only necessary in accordance with the present invention that the constraining member be resilient so as to enable the corresponding portion of the strap to assume a generally flat configuration prior to use and to provide for the bight portion of the loop formed by fastening the outer end of the strap in the loop forming configuration to be constrained to have a generally uniform curvature under the weight of an article supported thereby.

Figure 4:
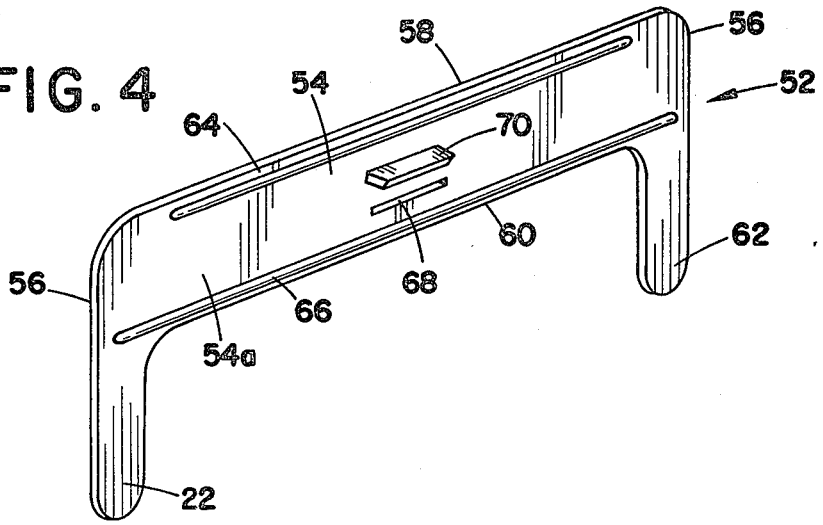
FIG. 4 is a perspective view of a bag stay made in accordance with the present invention.
Figure 5:
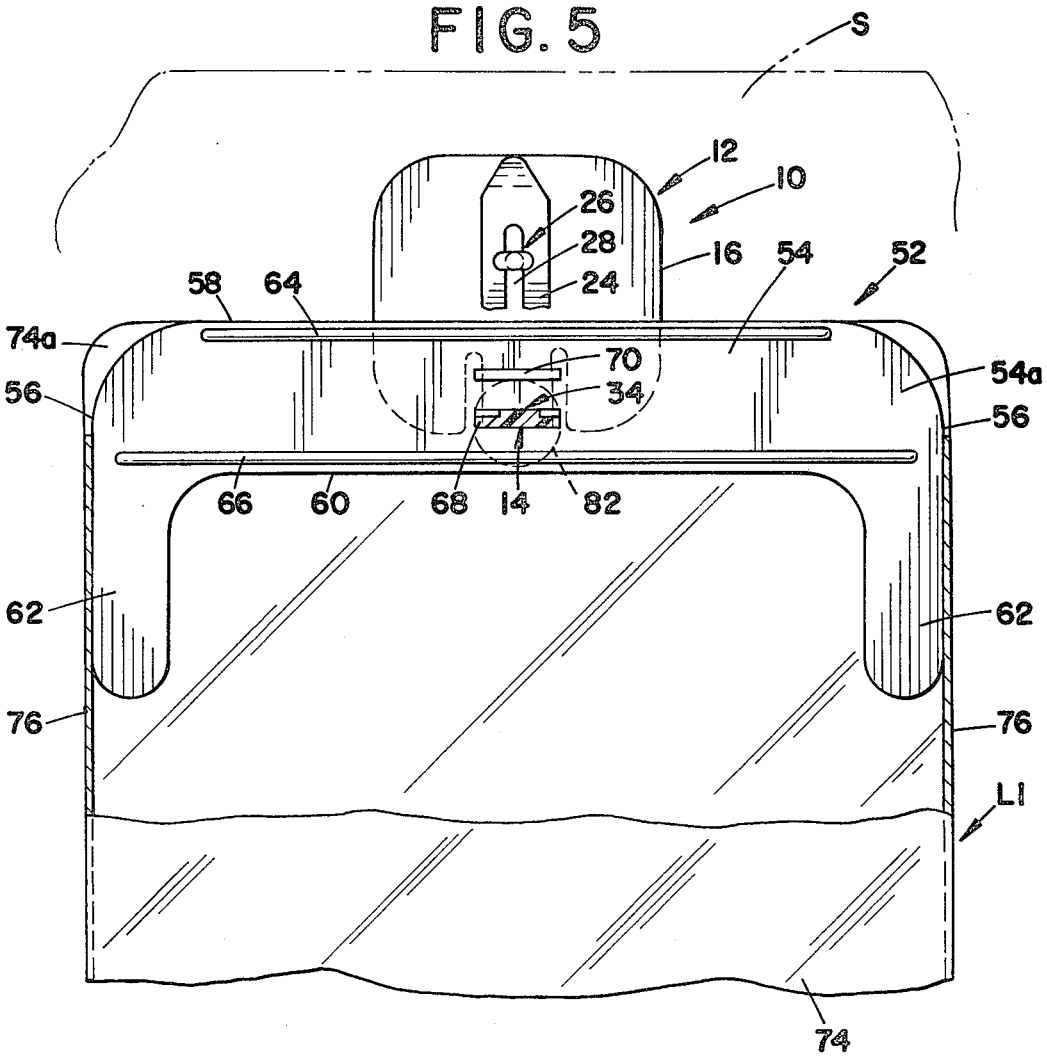
FIG. 5 is a front elevation view, partially in section, showing the bag stay and a bag in mounted relationship with respect to the article support of FIGS. 1–3.
Figure 6:
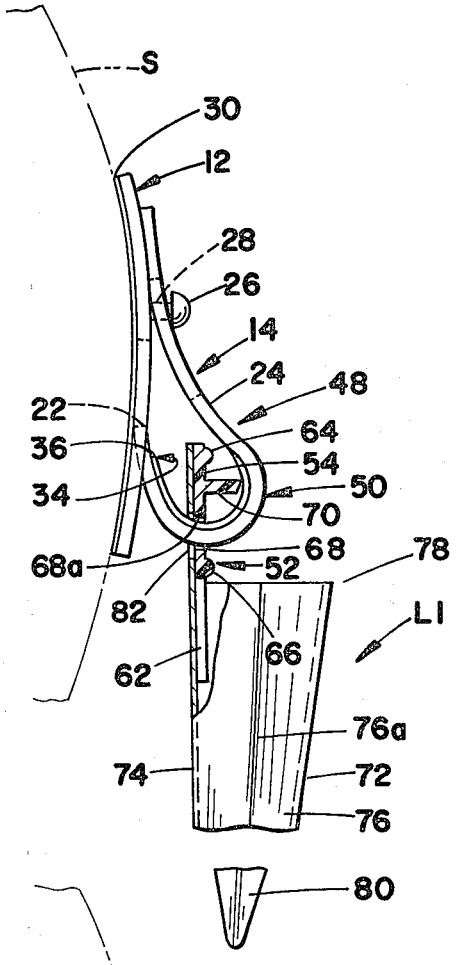
FIG. 6 is a side elevation view similar to FIG. 3 and showing the stay and bag in mounted relationship with respect to the article support; and, FIG. 7 is a side elevation view similar to FIG. 6 and illustrating a modification of the stay component.

In accordance with another aspect of the present invention, a bag stay component is provided for use with the article support described hereinabove as well as with other article supports of the type having a split ring or loop by which an article is supported in suspension. With reference to FIGS. 4–6, the bag stay is designated generally by the numeral 52 and is of one-piece construction produced from a thin sheet of suitable plastic material such as polypropylene. The stay has a generally C-shaped configuration defined by a body portion 54 having opposite ends 56 and top and bottom edges 58 and 60, respectively, and a pair of legs 62 coplanar with the body portion at opposite ends 56 thereof and depending from botton edge 60. Body portion 54 has a length between opposite ends 56 thereof corresponding to the width of a bag with which the stay is associated as will become apparent hereinafter. It will be appreciated that body portion 54 and legs 62 have corresponding opposite sides with regard to the plane thereof, one of which sides for body portion 54 is designated by the numeral 54*a* in FIGS. 4 and 5. Preferably, at least one of the opposite sides of body portion 54 is provided with integral, raised reinforcing ribs extending therealong in the direction between opposite ends 56, such as the ribs 64 and 66 illustrated in FIGS. 4–6 as extending along side 54*a* of the body portion respectively adjacent top and bottom edges 58 and 60 thereof. Ribs 62 and 64 advantageously restrain deflection of stay 52 transverse to the plane thereof, and it will be appreciated that such ribs could be provided on the other side of the body portion or on both sides thereof.

Body portion 54 is provided with a rectangular opening 68 therethrough generally centrally of the body portion with respect to opposite ends 56 thereof. In the embodiment illustrated, stay 52 is adapted to be associated with the loop of the article support described hereinabove in connection with FIGS. 1–3 of the drawing. In this respect, and for the purpose set forth hereinafter, opening 68 is adapted to receive strap portion 14 of the article support and has a rectangular contour. More particularly, opening 68 has a width in the direction between ends 56 slightly greater than the width of strap portion 14 and has a height in the direction between edges 58 and 60 of body portion 54 corresponding to the thickness of strap portion 14 in the area of the bight portion of the loop formed thereby. Body portion 54 is further provided with an integral rectangular projection 70 perpendicular to and extending outwardly from side 54*a* of the body portion. Projection 70 has a width in the direction between opposite ends 56 corresponding to the width of opening 68 and projects outwardly from side 54*a* a distance which provides for the outer end thereof to engage strap portion 14 of the article support as described more fully hereinafter.

FIGS. 5 and 6 of the drawing illustrate stay component 52 in mounted relationship with article support device 10 described hereinabove, whereby the component parts of the latter are numbered in accordance with FIGS. 1–3 of the drawing. Further, FIGS. 5 and 6 illustrate stay component 52 in association with a litter bag L1 of thin flexible material such as paper or plastic having front and back walls 72 and 74, respectively, and opposite sidewalls 76 between the front and back walls. The bag has an open upper end 78, and the lower ends of walls 72, 74 and 76 are suitably interengaged to provide the bag with a closed bottom 80. Further, back wall 74 includes a portion 74*a* extending about the top edges of front wall 72 and sidewalls 76, and the back wall is provided with a circular opening 82 to facilitate mounting the bag on article support 10. Preferably, the bag is of a character adapted to be collapsed to a flat condition prior to use and, for this purpose, sidewalls 76 are adapted to be folded inwardly between front wall 72 and back wall 74 along a crease line 76*a*. It will be appreciated of course that back wall 74 of the bag has a width corresponding to the distance between the opposite ends 56 of stay component 52 or, alternatively, that the stay component has a width between ends 56 corresponding to the width of a particular bag to be used in connection therewith.

In mounting the stay component and bag on article support 10, stay component 52 is introduced into the open upper end of the bag adjacent back wall 74 for opening 68 in the stay component and opening 82 in the bag to be in alignment with one another. Strap portion 14 of article support 10 is then introduced through opening 82 and opening 68 and is attached to button 26 for the strap portion to form loop 48 as described hereinabove. When strap portion 14 has been so attached to button 26, projection 70 extends forwardly into engagement with the loop as shown in FIG. 6. More particularly, projection 70 extends forwardly a distance sufficient for such engagement to push upper edge 68*a* of opening 68 in the stay component into frictional engagement with the inner surface of constraining component 34 of strap portion 14. This provides for stay component 52 to be frictionally restrained to remain in a generally vertical disposition as shown in FIG. 6 in response to the pulling of front wall 72 of the bag forwardly so as to open the upper end thereof for the insertion of an article into the bag. Furthermore, during such displacement of front wall 72, body portion 54 and legs 62 of the stay component retain back wall 74 of the bag in a desired planar configuration against forward distortion which would result if the stay component were not used. As will be appreciated from FIG. 5, the rectangular configuration of opening 68 through stay component 52 provides for the upper and lower edges of opening 68 to interengage with the bottom of strap portion 14 and the top surface of constraining member 34 so as to stabilize stay component 52 and thus bag L1 against pivotal displacement relative to the loop about the axis of opening 68. It will be further appreciated that projection 70 engages the loop to restrain pivotal displacement of stay 52 and thus the bag about a vertical line in the plane of the stay and laterally centrally of opening 68. Such stability against pivotal movement achieved as a result of the configuration of opening 68 relative to the cross-sectional configuration of strap portion 14 and the engagement of projection 70 within the loop advantageously facilitates the opening of the upper end of the bag for the deposit of articles therein without having to grasp the bag with one hand in order to stabilize the bag as heretofore required.

In connection with a preferred embodiment of article support 10 described hereinabove and the structure of stay component 52 illustrated and described herein, the foregoing desired stabilizing characteristics are achieved by providing for body portion 54 and legs 62 to have a thickness of about 0.0625 inch. Opening 68 has a vertical height of about 0.070 inch and a width of about 0.60 inch. Further, body portion 54 has a width of about 5.70 inches for use with a bag having a width of 6.0 inches across the back wall thereof, and body portion 54 has a dimension of about 1.0 inch between top and bottom edges 58 and 60 thereof, and opening 68 has an axis spaced about 0.650 inch below top edge 58. Projection 70 is generally centered vertically between the axis of opening 68 and top edge 58 of body portion 54 and projects about 0.30 inch from side 54*a*. Legs 62 extend downwardly about 1.50 inch below bottom edge 60 and have a width of about 0.50 inch. It will be appreciated that body portion 54 could be rectangular rather than C-shaped as illustrated, the latter being preferred from the standpoint of minimizing the plastic material required.

Figure 7:
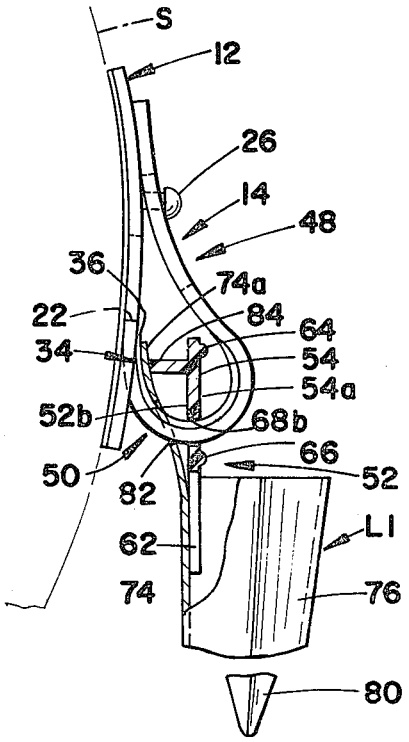

FIG. 7 of the drawing illustrates a modification of stay device 52 in which a projection 84 corresponding to projection 70 in FIGS. 4–6 is provided on the opposite side of body portion 54 from that of projection 70, which opposite side is designated 54*b* in FIG. 7. Thus, projection 84 extends towards mounting portion 12 of the article support and, preferably, is disposed adjacent top edge 58 of body portion 54. This orientation of projection 84 provides for extension 74*a* of back wall 74 of bag L1 to be captured between projection 84 and constraining member 34 of strap portion 14 of the article support and adjacent upper end 36 of the constraining member. Further, projection 84 has a length in the direction toward constraining member 34 which provides for stay 52 to be pushed forwardly for edge 68*b* of opening 68 therein to engage against the loop to frictionally stabilize stay 52 as described hereinabove with regard to FIGS. 4–6. Additionally, extension 74*a* of back wall 74 of the litter bag is advantageously clampingly interengaged between projection 84 and constraining member 34 to further stabilize the litter bag against lateral displacement relative to stay 52.

While the embodiments of stay 52 have been illustrated and described herein in conjunction with the preferred embodiment of an article holder according to the present invention, it will be appreciated that the stay component can be employed with any article holder of the character having a ring or loop portion for receiving and supporting a bag such as a litter bag, such as the split-ring type article holders disclosed in my aforementioned patents. Moreover, it will be appreciated that the cross-sectional configuration of the loop or ring portion of the article support receiving the stay, and the configuration of the opening through the stay receiving the ring or loop portion, can be of contours other than rectangular. In this respect, it is only necessary that the contours of the opening and loop provide for interengagement therebetween to restrain displacement of the stay relative to the ring or loop about the axis of the opening through the stay, while providing for the projection to push the stay into frictional engagement with the ring or loop against rocking displacement transverse to the plane of the stay. It will be further appreciated that the vertical location of the projection on the body portion and the extent of projection thereof from the body portion can readily be determined for the purpose of obtaining the desired stability in connection with a given loop or ring contour.

As many embodiments of the present invention can be made, and as many changes can be made in the preferred embodiments herein illustrated and described, it is to be distinctly understood that the foregoing descriptive matter is to be interpreted merely as illustrative of the present invention and not as a limitation.

Having thus described the invention, it is claimed:

1. An article support comprising a mounting portion and a strap portion of thin flexible plastic material, said mounting portion and strap portion having corresponding front and back sides, means on said back side of said mounting portion for attaching said article support to a surface, said strap portion having an inner end interconnected with said mounting portion along a line of juncture and an outer end spaced from said line of juncture, said outer end of said strap portion being displaceable toward said mounting portion and to a fastening position in which said strap portion forms an article supporting loop having a bight portion between said line of juncture and said outer end for supporting an article in suspension means to releaseably retain said outer end of said strip portion in said fastening position, and said strap portion including constraining means between said line of juncture and said outer end constraining said bight portion of said loop to have a generally uniform curvature under the weight of an article supported in suspension thereby, said mounting portion having an outer peripheral edge and said inner end of said strap portion being defined by slits extending inwardly of said peripheral edge and having terminal ends spaced inwardly from said peripheral edge, said terminal ends being spaced apart to define said line of juncture between said inner end of said strap portion and said mounting portion, said constraining means including plastic member means integral with said front side of said strap portion and having an outer surface spaced outwardly from said front side, said plastic member means having a first end adjacent said terminal ends of said slots and a second end spaced from said first end in the direction toward said outer end of said strap portion, said outer surface of said plastic member means converging toward said front side of said strap portion in the direction from said first end toward said second end, said plastic member means further having opposite side edges between said first and second ends and converging with respect to one another in the direction from said first end toward said second end, and said means to releaseably retain said outer end of said strap portion in said fastening position including interengaging fastener means on said front side of said mounting portion and said outer end of said strap portion.

2. An article support according to claim 1, wherein said interengaging fastener means includes a button member integral with said mounting portion and spaced inwardly from said terminal ends of said slits, and an opening through said outer end of said strap portion to receive said button member.

3. A stay device for stabilizing a bag of thin flexible material supported in suspension from article support means including article supporting loop means having a non-circular cross-section, said bag having front and rear walls and sidewalls therebetween and an open upper end and closed bottom, and said rear wall having an opening therethrough adjacent said upper end receiving said loop means for said bag to be supported in suspension therefrom, said stay device including a generally planar body portion of plastic sheet material received in said open upper end of said bag adjacent said rear wall thereof, said body portion extending along said rear wall between said sidewalls of said bag and having opposite sides respectively facing said front and rear walls of said bag, said body portion having an opening therethrough aligned with said opening in said rear wall and receiving said loop means for said stay device to be supported in suspension therefrom, said opening in said body portion having a non-circular contour providing for interengagement with said loop means to restrain displacement of said stay device relative to said loop means in the plane of said body portion, and projection means on one of said opposite sides of said body portion and above said opening therethrough, said projection means engaging said loop means to restrain displacement of the plane of said body portion relative to said loop means.

4. The stay device according to claim 3, wherein said body portion has top and bottom edges extending in the direction between said sidewalls of said bag, and reinforcing rib means on one of said opposite sides of said body portion extending parallel to said edges.

5. The stay device according to claim 3, wherein said body portion has opposite ends each adjacent a different one of said sidewalls of said bag, and a leg at each said opposite end coplanar with said body portion and extending downwardly from said body portion along said rear wall of said bag.

6. The stay device according to claim 3, wherein said projection means is on the side of said body portion facing said front wall of said bag.

7. The stay device according to claim 6, wherein said body portion has an upper edge extending in the direction between said sidewalls of said bag, said projecting means being generally centrally disposed between said upper edge and said opening through said body portion.

8. The stay device according to claim 3, wherein said projection means is on the side of said body portion facing said rear wall of said bag.

9. The stay device according to claim 8, wherein said body portion has an upper edge extending in the direction between said sidewalls of said bag, said projection means being closer to said upper edge than to said opening through said body portion.

10. The stay device according to claim 3, wherein said opening through said body portion is rectangular and has a width dimension in the direction between said sidewalls of said bag, and said projection means has a width dimension in said direction and corresponding to the width dimension of said opening through said body portion.

11. The stay device according to claim 10, wherein said projection means is on the side of said body portion facing said front wall of said bag and wherein said body portion has an upper edge extending in the direction between said sidewalls of said bag, said projecting means being generally centrally disposed between said upper edge and said opening through said body portion.

12. The stay device according to claim 11, wherein said body portion has top and bottom edges extending in the direction between said sidewalls of said bag, and reinforcing rib means on one of said opposite sides of said body portion extending parallel to said edges.

13. The stay device according to claim 12, wherein said body portion has opposite ends each adjacent a different one of said sidewalls of said bag, and a leg at each of said opposite ends coplanar with said body portion and extending downwardly from said body portion along said rear wall of said bag.

14. The stay device according to claim 10, wherein said projection means is on the side of said body portion facing said rear wall of said bag and wherein said body portion has an upper edge extending in the direction between said sidewalls of said bag, said projection means being closer to said upper edge than to said opening through said body portion.

15. The stay device according to claim 14, wherein said body portion has top and bottom edges extending in the direction between said sidewalls of said bag, and reinforcing rib mean on one of said opposite sides of said body portion extending parallel to said edges.

16. The stay device according to claim 15, wherein said body portion has opposite ends each adjacent a different one of said sidewalls of said bag, and a leg at each of said opposite ends coplanar with said body portion and extending downwardly from said body portion along said rear wall of said bag.

* * * * *